US009994057B2

(12) United States Patent
Mochizuki et al.

(10) Patent No.: US 9,994,057 B2
(45) Date of Patent: Jun. 12, 2018

(54) SADDLE-STITCH AND FOLD MACHINE

(71) Applicant: Horizon International Inc., Takashima-shi, Shiga (JP)

(72) Inventors: Jun Mochizuki, Takashima (JP); Katsunori Ishida, Takashima (JP); Tomoyuki Shimizu, Takashima (JP)

(73) Assignee: HORIZON INTERNATIONAL INC., Shiga (JP)

( * ) Notice: Subject to any disclaimer, the term of this patent is extended or adjusted under 35 U.S.C. 154(b) by 0 days. days.

(21) Appl. No.: 14/765,389

(22) PCT Filed: Mar. 13, 2013

(86) PCT No.: PCT/JP2013/057051

§ 371 (c)(1),
(2) Date: Aug. 3, 2015

(87) PCT Pub. No.: WO2014/141410

PCT Pub. Date: Sep. 18, 2014

(65) Prior Publication Data

US 2015/0375555 A1 Dec. 31, 2015

(51) Int. Cl.
*B42C 9/00* (2006.01)
*B42C 13/00* (2006.01)
(Continued)

(52) U.S. Cl.
CPC ..... *B42B 2/02* (2013.01); *B42B 4/00* (2013.01); *B42C 1/12* (2013.01); *B42C 5/00* (2013.01);
(Continued)

(58) Field of Classification Search
CPC .. B42C 9/00; B42C 13/00; B42C 5/00; B42B 5/00; B42B 2/00
(Continued)

(56) References Cited

U.S. PATENT DOCUMENTS

2004/0071529 A1* 4/2004 Kawatsu ..... B42B 2/00 412/35
2010/0278618 A1 11/2010 Hata
(Continued)

FOREIGN PATENT DOCUMENTS

JP 2003-211865 A 7/2003
JP 2010-163226 A 7/2010
(Continued)

OTHER PUBLICATIONS

International Search Report dated Apr. 9, 2013, issued in counterpart application No. PCT/JP2013/057051 (2 pages).
(Continued)

*Primary Examiner* — Justin V Lewis

(74) *Attorney, Agent, or Firm* — Westerman, Hattori, Daniels & Adrian, LLP

(57) ABSTRACT

The creaser 2 includes a project part 21 for forming the crease 120 on the sheet 101 and a receive part 22 for receiving the project part 21. The project part 21 is moved between a crease position and a standby potion, the project part 21 being at the crease position so as to form the crease 120 on the sheet 101, the project part 21 being away from the sheet 101 at the standby position so as not to form the crease 120 on the sheet 101. The input device 6 includes a selector 60 for selecting the sheet 101 to be creased by the creaser 2 from among the sheets 101 fed from the conveyer 1, the input device 6 sending the information of the selection to the controller 5.

4 Claims, 9 Drawing Sheets

(51) Int. Cl.

| | |
|---|---|
| ***B42C 5/00*** | (2006.01) |
| ***B42B 5/00*** | (2006.01) |
| ***B42B 2/00*** | (2006.01) |
| ***B42B 2/02*** | (2006.01) |
| ***B42C 19/02*** | (2006.01) |
| ***B42C 19/08*** | (2006.01) |
| ***B65H 5/06*** | (2006.01) |
| ***B65H 7/20*** | (2006.01) |
| ***B65H 37/04*** | (2006.01) |
| ***B65H 37/06*** | (2006.01) |
| ***B65H 43/00*** | (2006.01) |
| ***B65H 43/08*** | (2006.01) |
| ***B65H 45/30*** | (2006.01) |
| ***B42B 4/00*** | (2006.01) |
| ***B65H 45/18*** | (2006.01) |
| ***B42C 1/12*** | (2006.01) |
| ***B42C 5/04*** | (2006.01) |

(52) U.S. Cl.
CPC ..... *B42C 5/04* (2013.01); *B42C 13/003* (2013.01); *B42C 19/02* (2013.01); *B42C 19/08* (2013.01); *B65H 5/068* (2013.01); *B65H 7/20* (2013.01); *B65H 37/04* (2013.01); *B65H 37/06* (2013.01); *B65H 43/00* (2013.01); *B65H 43/08* (2013.01); *B65H 45/18* (2013.01); *B65H 45/30* (2013.01); *B65H 2701/1829* (2013.01)

(58) Field of Classification Search
USPC ..... 412/9, 11, 14, 22, 25, 33, 35
See application file for complete search history.

(56) References Cited

U.S. PATENT DOCUMENTS

| | | | | |
|---|---|---|---|---|
| 2010/0310340 | A1 | 12/2010 | Suzuki et al. | |
| 2011/0064541 | A1 | 3/2011 | Kikkawa et al. | |
| 2011/0229287 | A1* | 9/2011 | Suzuki ..... | B65H 45/18 412/1 |
| 2012/0243962 | A1* | 9/2012 | Kato ..... | B65H 45/18 412/22 |
| 2013/0011219 | A1 | 1/2013 | Musha et al. | |

FOREIGN PATENT DOCUMENTS

| | | | |
|---|---|---|---|
| JP | 2011-16656 | A | 1/2011 |
| JP | 2011-57424 | A | 3/2011 |
| JP | 2011-195243 | A | 10/2011 |
| JP | 2012-46311 | A | 3/2012 |
| JP | 2013-18572 | A | 1/2013 |
| JP | 2014-016468 | A | 1/2014 |

OTHER PUBLICATIONS

International Preliminary Report dated Sep. 15, 2015, issued in counterpart application No. PCT/JP2013/057051 (5 pages).

European Search Report dated Dec. 23, 2016, issued in corresponding European Patent Application No. EP13878258 (3 pages).

* cited by examiner

SADDLE-STITCH AND FOLD MACHINE

TECHNICAL FIELD OF THE INVENTION

The present invention relates to a saddle-stitch and fold machine that manufactures a booklet.

BACKGROUND OF THE INVENTION

There is a first conventional saddle-stitch and fold machine. As shown in FIG. 4 of Patent Document 1, the first conventional machine includes a saddle-stitcher that saddle-stitches sheets printed by a printer, and a folder that folds a sheet stack fed from the saddle-sticher. The sheet stack folded by the folder becomes one booklet.

As shown in FIG. 9A, the first conventional machine manufactures the booklet from a plurality of the sheets. The sheets are printed by the printer using a toner colorant. The toner colorant along a fold line may fall off an outer sheet (cover) 101*a* disposed on an outermost portion of the booklet 100, which is called as "toner crack 110". Further, as shown in FIG. 9B, the first conventional machine cannot fold the sheet stack neatly because the fold line of the booklet is swelled, which is called as "swell".

There is a second conventional saddle-stitch and fold machine. As shown in FIGS. 1 to 3 of Patent Document 1, the second conventional machine includes a creaser that forms a crease on all of the sheets printed by the printer; a saddle-stitcher that stacks the sheets fed from the creaser and saddle-stitches the sheet stack along the crease; and a folder that folds the sheet stack fed from the saddle-stitcher along the crease.

As described above, according to the second conventional machine, the creaser forms the crease on all of the sheets. Thus, the "toner crack 110" is not occurred on the "outer sheet (cover) 101*a*" even though the sheets are printed by the printer using a toner colorant. Further, the second conventional machine can fold the sheet stack neatly because the "swell" is not occurred along the fold line of the booklet.

However, according to the second conventional machine, the "toner crack 110" may be occurred on an "inner sheet 101*b*" that is disposed on an innermost portion of the booklet 100.

Patent Document 1: JP 2003-211865 A

SUMMARY OF THE INVENTION

Problems to be Solved by the Invention

It is an object of the present invention to provide a saddle-stitch and fold machine that manufactures a booklet that does not have the "toner crack" and the "swell" along a fold line.

Solution to the Problems

In order to achieve the object, the present invention provides a saddle-stitch and fold machine. The saddle-stitch and fold machine comprising: a conveyer that feeds a plurality of sheets one by one in a feed direction; a detector that detects a passage of a front end of the sheet fed from the conveyer so as to send a detect signal; a creaser that forms a crease on the sheet fed from the conveyer; a saddle-stitcher that stacks the sheets fed from the creaser so as to make a sheet stack, and saddle-stitches the sheet stack along the crease; a folder that folds the sheet stack fed from the saddle-stitcher along the crease; a controller that controls the creaser, the saddle-stitcher and the folder; and an input device that receives input from an operator. The creaser includes: a project part that forms the crease on the sheet; and a receive part that receives the project part. The project part is moved between a crease position and a standby position. The project part forms the crease on the sheet when the project part is at the crease position. The project part does not form the crease on the sheet when the project part is away from the sheet at the standby position. The input device includes a selector. The sheet to be creased by the creaser is selected through the selector by the operator. The input device sends select information on the sheet to be creased toward the controller. The controller controls the creaser based on both the select information from the input device and the detect signal from the detector, whereby the sheet is creased by the project part disposed at the crease position when the sheet to be creased is fed from the conveyer toward the creaser; and the sheet is not creased by the project part disposed at the standby position when the sheet not to be creased is fed from the conveyer toward the creaser.

According to a preferable embodiment of the machine, wherein the sheet stack to be folded by the folder corresponds to one booklet, and the sheet stack is composed of: one outer sheet disposed on an outermost portion after the sheet stack is folded; one inner sheet disposed on an innermost portion after the sheet stack is folded; and at least one center sheet disposed between the outer and inner sheets. The selector includes: a first part for selecting whether to form the crease on the outer sheet; a second part for selecting whether to form the crease on the center sheet; and a third part for selecting whether to form the crease on the inner sheet.

According to a preferable embodiment of the machine, wherein the creaser comprises: a crease roller that extends in a direction perpendicular to the feed direction, the crease roller including the project part that extends in the direction perpendicular to the feed direction; a receive roller that is opposed to the crease roller and extends in the direction perpendicular to the feed direction so as to receive the crease roller; a motor that rotates the crease roller; a pair of feed rollers that extends in the direction perpendicular to the feed direction so as to nip and feed the sheet; and a rotary encoder that detects number of rotations of the feed roller so as to send a detect signal. The controller recognizes a position of the sheet based on the detect signals from both the detector and the rotary encoder so as to control the motor, whereby the project part is moved toward the crease position by a rotation of the crease roller so as to form the crease on a predetermined position of the sheet when the sheet to be creased is fed from the conveyer toward the creaser; and the project part is stopped at the standby position by a non-rotation of the crease roller so as not to form the crease when the sheet not to be creased is fed from the conveyer toward the creaser.

Effect of the Invention

As above described, the saddle-stitch and fold machine according to the present invention includes the controller that controls the creaser, the saddle-stitcher and the folder; the input device that receives input from an operator; and the detector that detects the passage of the front end of the sheet fed from the conveyer. The creaser includes the project part that forms the crease on the sheet; and the receive part that receives the project part. The project part is movable between the crease and standby potions. The project part prongs the sheet at the crease position so as to form the crease on the sheet. The project part is away from the sheet at the standby position so as not to form the crease on the sheet.

Further, the input device includes the selector. The sheet to be creased by the creaser is selected through the selector by the operator. Further, the sheet not to be creased is selected through the selector by the operator. The selector of the input device sends select information toward the controller. The controller controls the creaser based on both the select information from the input device and the detect signal from the detector. The sheet is creased by the project part disposed at the crease position when the sheet to be creased is fed from the conveyer toward the creaser. The sheet is not creased by the project part disposed at the standby position when the sheet not to be creased is fed from the conveyer toward the creaser.

As above described, according to the machine of the present invention, an operator can select the sheet to be creased from among the sheets fed from the conveyer toward the creaser. Thus, the operator can select the sheet to be creased in view of the relation between the qualities of the sheet and/or the toner colorant. Consequently, the machine can manufacture the booklet that does not have the "toner crack" and the "swell" according to various types of sheets and printers.

DETAILED EXPLANATION OF THE PREFERRED EMBODIMENTS

A saddle-stitch and fold machine according to the present invention will be explained below with reference to the drawings.

Figure 1:
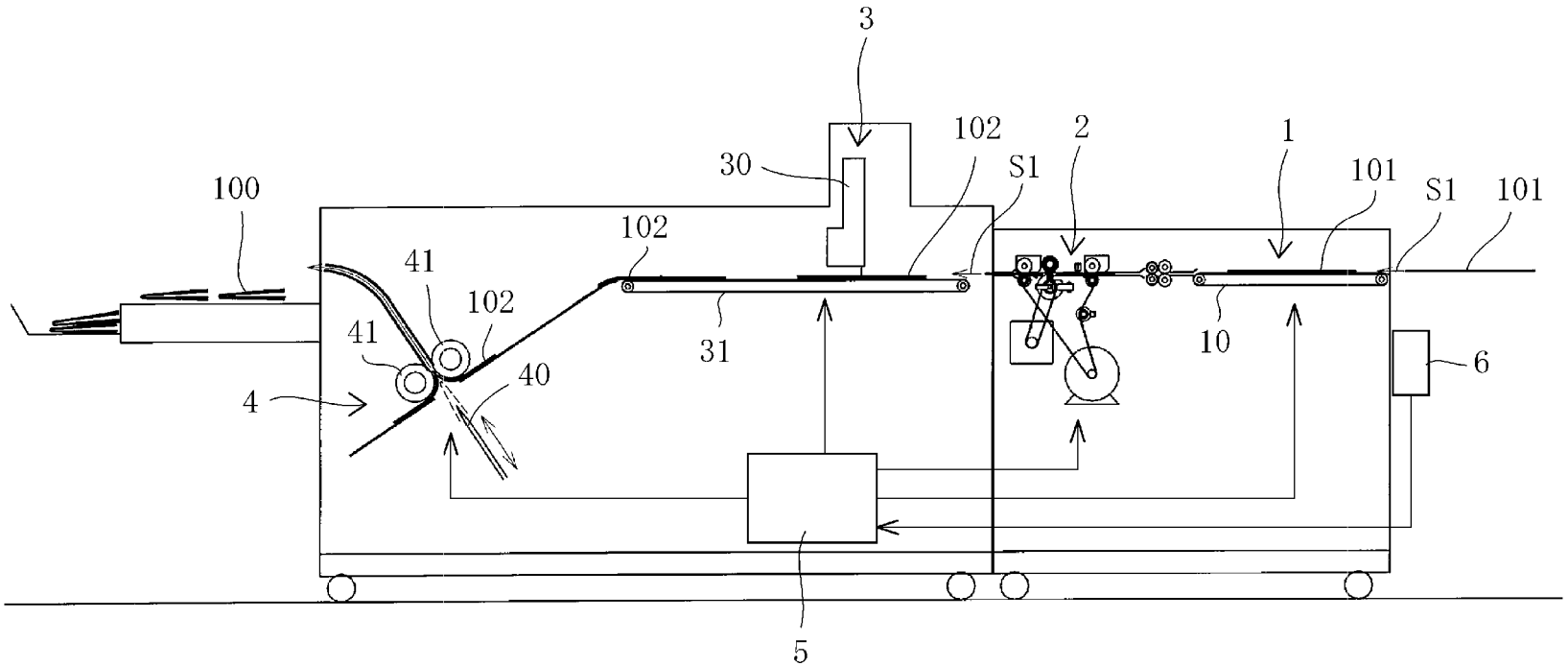
FIG. 1 is a side view showing an embodiment of a saddle-stitch and fold machine.
Figure 2:
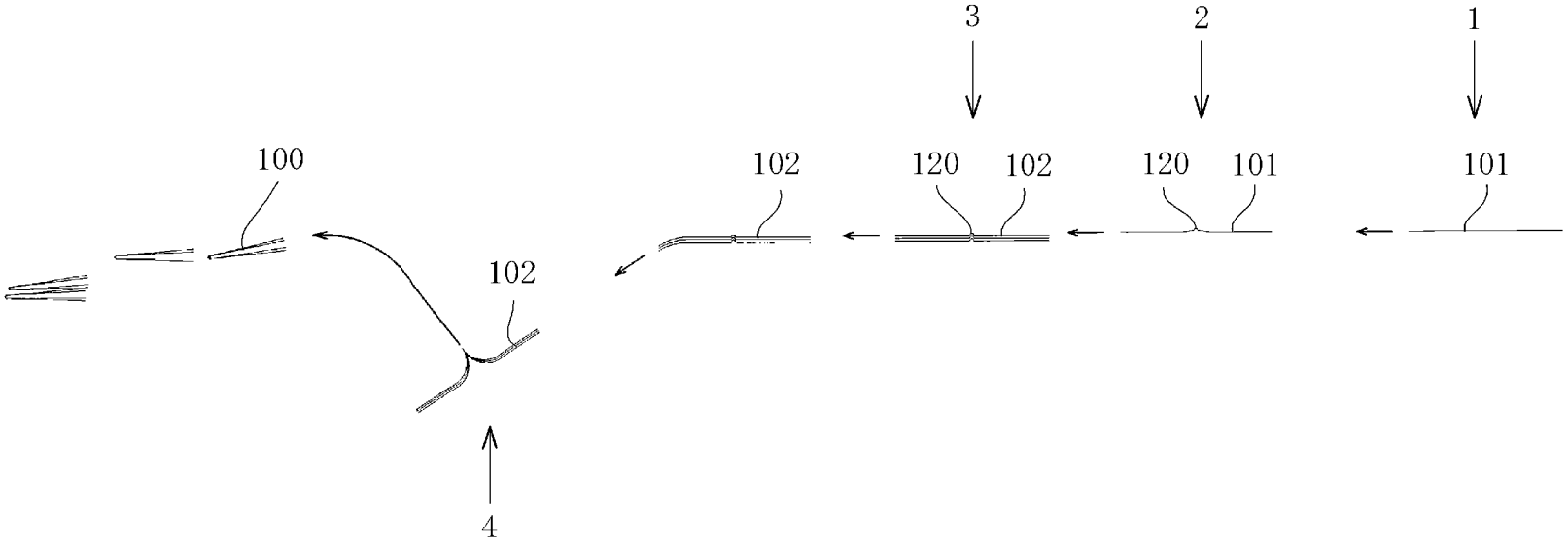
FIG. 2 is a side view illustrating a process for manufacturing a booklet using the machine.

As shown in FIGS. 1 and 2, the saddle-stitch and fold machine includes a conveyer 1 that feeds a sheet 101 one by one in a feed direction S1; a creaser 2 that forms a crease 120 on the sheet 101 fed from the conveyer 1; a saddle-stitcher 3 that stacks a plurality of the sheets 101 fed from the creaser 2. The saddle-stitcher 3 makes a sheet stack 102 and saddle-stitches the sheet stack 102 along the crease 120. The saddle-stich further includes a folder 4 that folds the sheet stack 102 fed from the saddle-stitcher 3 along the crease 120. The machine further includes a controller 5 that controls the creaser 2, the saddle-stitcher 3 and the folder 4.

The conveyer 1 includes a feed belt conveyer 10 that feeds the sheets 101 one by one toward the creaser 2.

The creaser 2 forms the crease 120 on the sheet 101. The crease 120 extends in a direction S2 (FIG. 3) perpendicular to the feed direction S1. The creaser 2 will be described in detail below.

The saddle-stitcher 3 includes a stitcher 30 and a feed belt conveyer 31. The saddle-stitcher 3 stacks a plurality of the sheets 101 so as to make the sheet stack 102. The sheet stack 102 is conveyed toward and beneath the stitcher 30 by the feed belt conveyer 31. As shown in FIG. 2, the sheet stack 102 is composed of the sheets 101 which are neatly arranged in such a manner that each of the creases 120 of the sheets 101 are superimposed. The stitcher 30 stitches the sheet stack 102 along the crease 120 at two to four portions with wires (not shown). The feed belt conveyer 31 feeds the stitched sheet stack 102 toward the folder 4.

The folder 4 includes a fold knife 40 and a pair of fold rollers 41. The stitched sheet stack 102 is pressed by the fold knife 40 along the crease 120. Then, the sheet stack 102 is nipped between the fold rollers 41 and 41 so as to be fed. Thus, the sheet stack 102 is folded along the crease 120 and discharged from the fold rollers 41. The folded sheet stack 102 corresponds to one booklet 100.

Figure 3:
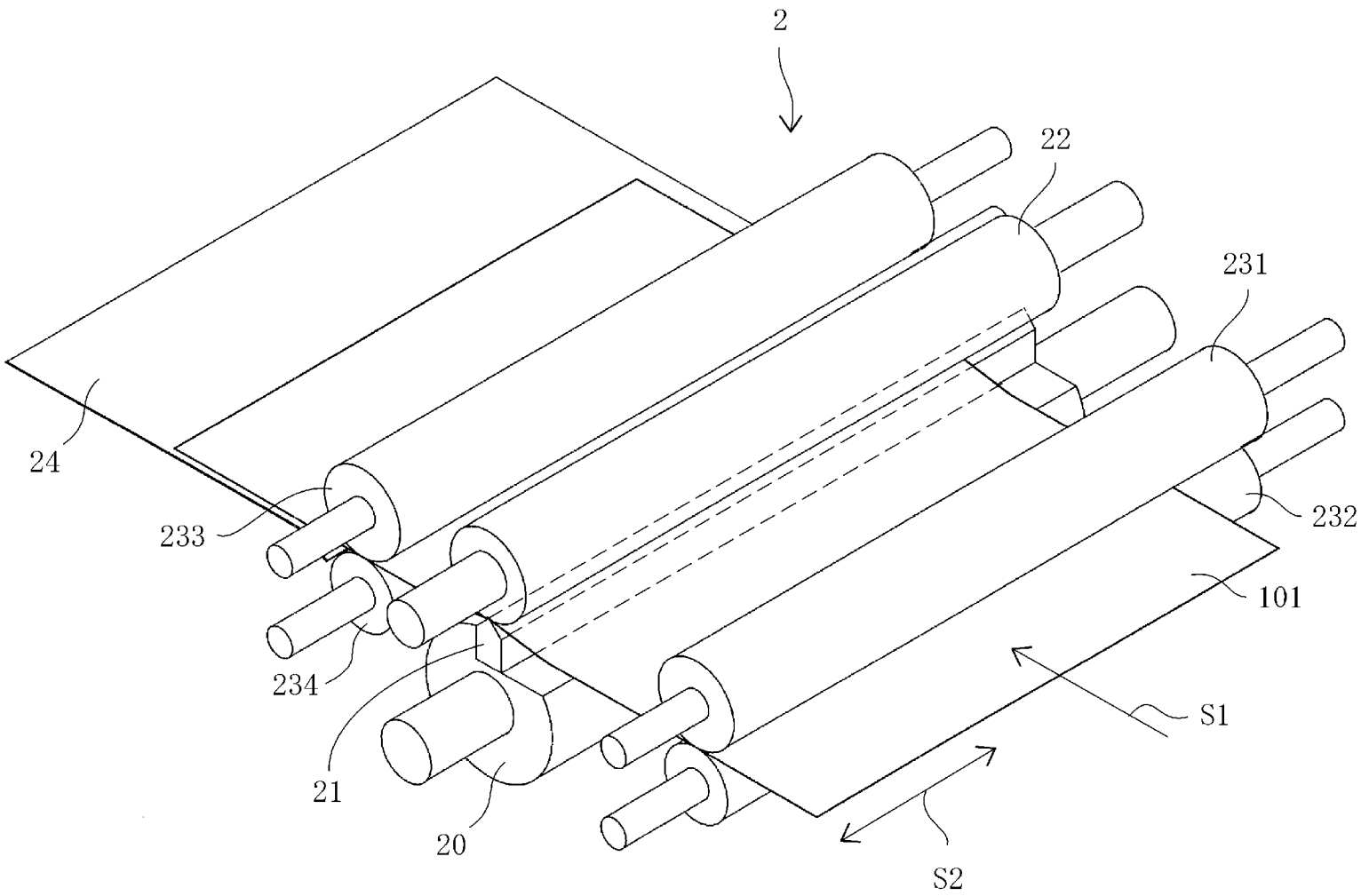
FIG. 3 is a perspective view showing a part of a creaser.

As shown in FIG. 3, the creaser 2 includes a crease roller 20 extending in the direction S2 perpendicular to the feed direction S1. The creaser 2 further includes a receive roller 22 opposed to the crease roller 20. The receive roller 22 extends in the direction S2. The crease roller 20 includes a project part 21 extending in the direction S2. The crease 120 is formed on the sheet 101 in the direction S2 by prodding the sheet 100 with a tip of the project part 21. The receive roller 22 is made of elastic material so as to receive the tip of the project part 21. The crease roller 20 has a roller surface 20*a* having a radius R, and a project part 21 extending beyond the radius R in the direction S2.

The creaser 2 includes a pair of first feed rollers 231 and 232. The first feed rollers 231 and 232 are opposed to each other so as to nip and feed the sheet 101 in the feed direction S1. The creaser 2 further includes a pair of second feed rollers 233 and 234. The second feed rollers 233 and 234 are opposed to each other so as to nip and feed the sheet 101 in the feed direction S1, parallel to the first feed rollers 231 and 232.

The crease and receive rollers 20 and 22 are disposed between the first feed rollers 231 and 232 and the second feed rollers 233 and 234. The first and second feed rollers 231 to 234 are parallel to the crease and receive rollers 20 and 22 in the direction S2. The sheet 101 is fed from the second feed rollers 233 and 234 in the feed direction S1.

Figure 4:
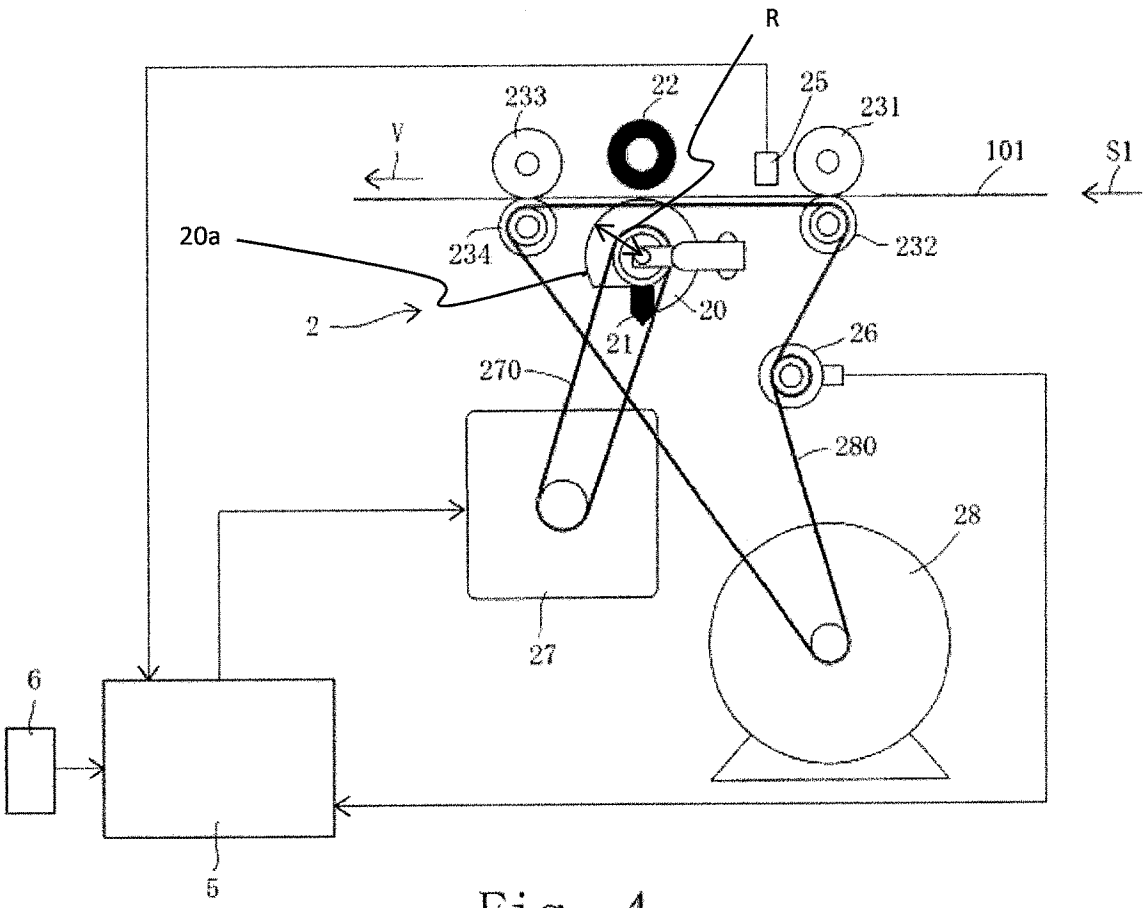
FIG. 4 is a side view showing the creaser when a project part is at a standby position.
Figure 5:
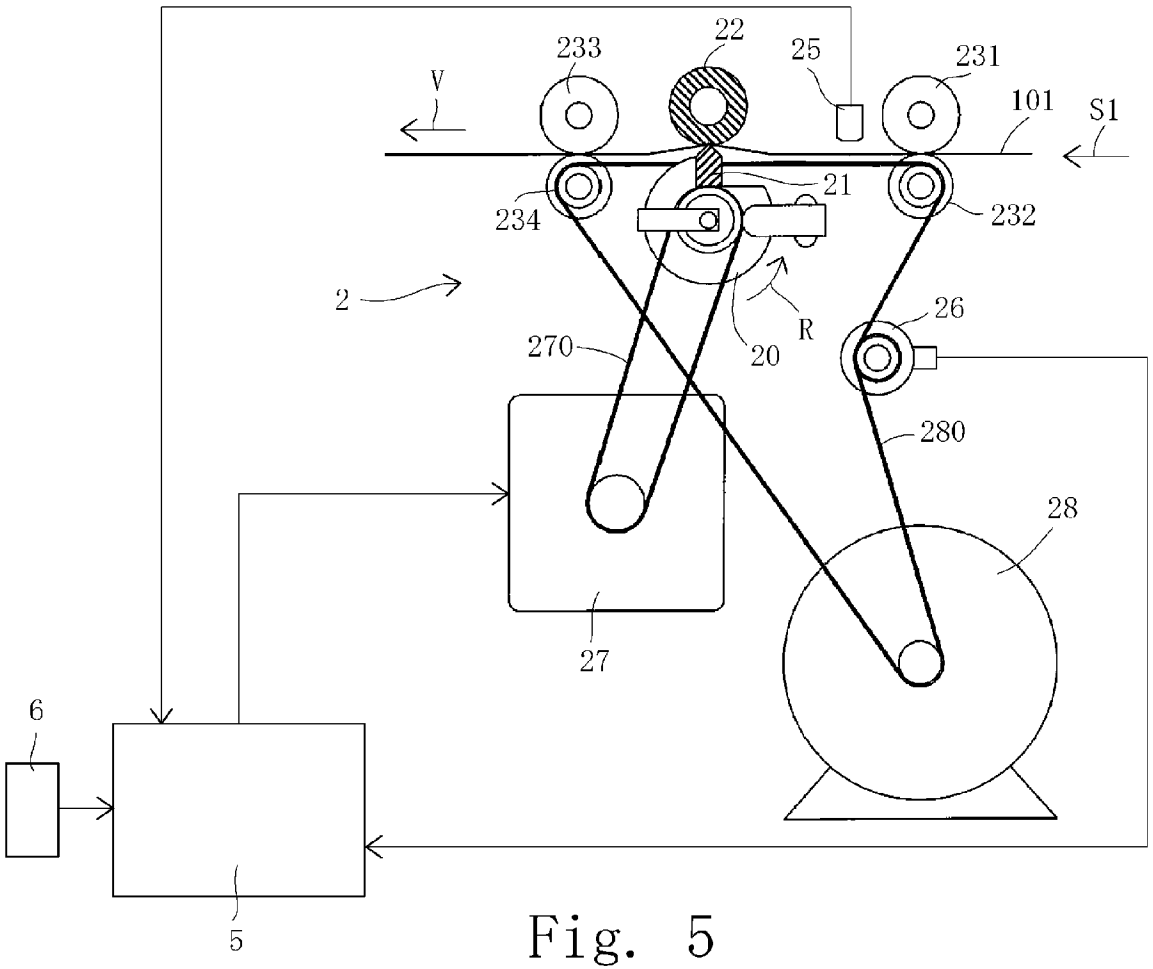
FIG. 5 is a side view showing the creaser when a project part is at a crease position.

As shown in FIGS. 4 and 5, the creaser 2 includes a motor 27 for rotating the crease roller 20. The crease roller 20 is connected to the motor 27 via an endless belt 270. The crease roller 20 is rotated by a rotation of an output axis of the motor 27 via the endless belt 270. The project part 21 moves between a crease position (FIG. 5) and a standby position (FIG. 4) by a rotation of the crease roller 20. The project part 21 at the crease position prods the sheet 101 so as to form the crease 120 on the sheet 101. The project part 21 at the standby position is away from the sheet 101 so as not to form the crease 120.

The creaser 2 includes a motor 28 for rotating the first and second feed rollers 231 to 234. One of the first feed rollers 232, one of the second feed rollers 234 and the motor 28 are connected to each other via the endless belt 280. The first and second feed rollers 231 to 234 are rotated by the rotation of the output axis of the motor 28 via the endless belt 280 so as to feed the sheet 101.

The endless belt 280 is connected with a rotary encoder 26 for detecting the number of rotations of the first and second feed rollers 231 to 234. A feed speed V of the sheet 101 can be detected by the rotary encoder 26.

The creaser 2 includes a detector 25 for detecting a passage of a front end of the fed sheet 101. The detector 25 is, for example, composed of an ultrasonic sensor, an optical sensor and so on. A position of the front end of the fed sheet 101 can be detected by the detector 25.

The motor 27, the rotary encoder 26 and the detector 25 are connected to the controller 5. The controller 5 controls the rotation of the motor 27 based on both detect signals of the rotary encoder 26 and the detector 25.

As shown in FIG. 1, the machine includes an input device 6 that receives input from an operator. The controller 5 controls the creaser 2, the saddle-stitcher 3 and the folder 4 based on the input from the operator through the input device 6.

Figure 6:
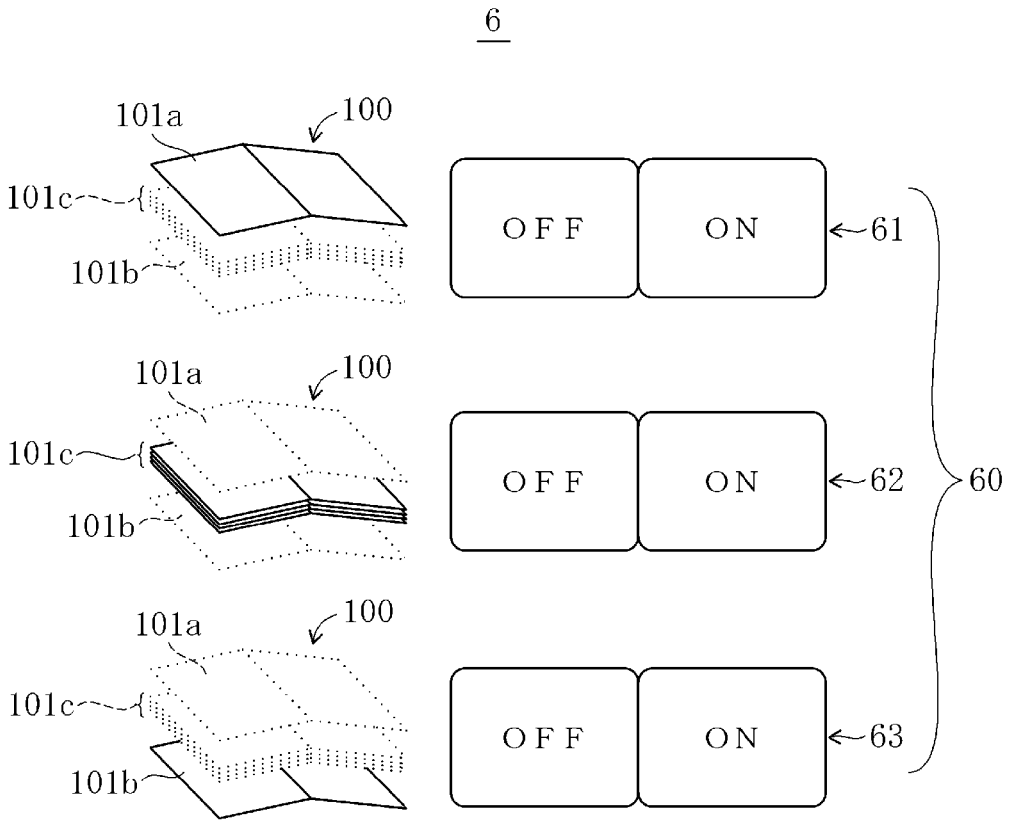
FIG. 6 is a front view showing a touch screen of an input device.

As shown in FIG. 6, the input device 6 is composed of a touch screen 6. The touch screen 6 displays a selector 60 for selecting the sheet 101 to be creased by the creaser 2 from among the sheets 101 fed from the conveyer 1. The selector 60 includes first, second and third parts 61, 62 and 63.

The first part 61 includes "on" and "off" buttons. At the left side of the first part 61 on the touch screen 6, there is an illustrative drawing of the booklet 100.

The booklet 100 is composed of one outer sheet (cover) 101*a*, one inner sheet 101*b* and at least one center sheet 101*c*. The outer sheet (cover) 101*a* is disposed on the outermost portion of the sheet stack 102. The inner sheet 101*b* is disposed on the innermost portion of the sheet stack 102. The center sheet (s) 101*c* is/are disposed between the outer and inner sheets 101*a* and 101*b*.

In the illustrative drawing of the booklet 100 at the left side of the first part 61, the outer sheet 101*a* is illustrated by a solid line. On the other hand, both of the inner and center sheets 101*b* and 101*c* are illustrated by a dot line. The operator presses the "on" or "off" button of the first part 61 according to the illustrative drawing. When the "on" button of the first part 61 is pressed by the operator, the crease 120 is formed on the outer sheet 101*a*. On the other hand, when the "off" button of the first part 61 is pressed by the operator, the crease 120 is not formed on the outer sheet 101*a*. For example, after the "on" or "off" buttons is pressed, the pressed button is highlighted so that the operator can easily recognize the pressed button.

The second part 62 also includes "on" and "off" buttons. At the left side of the second part 62 on the touch screen 6, there is an illustrative drawing of the booklet 100.

In the illustrative drawing of the booklet 100 at the left side of the second part 62, the center sheets 101*c* are illustrated by a solid line. On the other hand, both of the outer and inner sheets 101*a* and 101*b* are illustrated by a dot line. The operator presses the "on" or "off" button of the second part 62 according to the illustrative drawing. When the "on" button of the second part 62 is pressed by the operator, the crease 120 is formed on the center sheet (s) 101*c*. On the other hand, when the "off" button of the second part 62 is pressed by the operator, the crease 120 is not formed on the center sheet (s) 101*c*. For example, after the "on" or "off" buttons is pressed, the pressed button is highlighted so that the operator can easily recognize the pressed button.

The third part 63 also includes "on" and "off" buttons. At the left side of the third part 63 on the touch screen 6, there is an illustrative drawing of the booklet 100.

In the illustrative drawing of the booklet 100 at the left side of the third part 63, the inner sheet 101*b* is illustrated by a solid line. On the other hand, both of the outer and center sheets 101*a* and 101*c* are illustrated by a dot line. The operator presses the "on" or "off" button of the third part 63 according to the illustrative drawing. When the "on" button of the third part 63 is pressed by the operator, the crease 120 is formed on the inner sheet 101*b*. On the other hand, when the "off" button of the third part 63 is pressed by the operator, the crease 120 is not formed on the inner sheet 101*b*. For example, after the "on" or "off" buttons is pressed, the pressed button is highlighted so that the operator can easily recognize the pressed button.

When the booklet 100 is composed of N pieces of the sheet 101, the booklet 100 is composed of one (1) piece of the outer sheet 101*a*, one (1) piece of the inner sheet 101*b* and N−2 pieces of the center sheets 101*c*. The number N of the sheets 101 forming the one booklet 100 is previously memorized in the controller 5.

The detector 25 sends a detect signal toward the controller 5 when detecting the passage of the front end of the sheet 101. The rotary encoder 26 sends the number of the revolutions of the first and second feed rollers 231 to 234 toward the controller 5 at all times. Thus, the controller 5 can recognize both the position and the speed V of the sheet 101 fed by the first and second feed rollers 231 to 234.

The controller 5 controls the motor 27 based on the recognition of both the position and the speed V. The motor 27 rotates the crease roller 20 (the project part 21) in the same direction (a counterclockwise direction in FIG. 5) as the feed direction S1.

The controller 5 controls the motor 27 based on the passage of the front end of the sheet 101, the feed speed V of the sheet 101 and the rotary speed R of the crease roller 20 (FIG. 5) in such a manner that the project part 21 moves to the crease position (FIG. 5) so as to prod the predetermined portion of the fed sheet 101.

The controller 5 controls the motor 27 in such a manner that the project part 21 rotates one revolution from the standby position (FIG. 4) through the crease position (FIG. 5) toward the standby position (FIG. 4) at the constant rotary speed R so as to prod the predetermined portion of the fed sheet 101. Thus, the crease 120 is formed on the predetermined portion of the sheet 101 (for example, the center portion of the sheet 101 in the feed direction S1).

For example, the machine achieves the following operation when the "on" button of the first part 61, the "on" button of the second part 62 and the "off" button of the third part 63 are pressed. The selector 60 sends select information toward the controller 5. The "select information" means information on which and how the sheet 101 is selected through the first, second and third parts 61, 62 and 63 of the selector 60 by the operator. The controller 5 controls the creaser 2 based on both the select information from the selector 60 and the detect signal from the detector 25.

At first, the conveyer 1 feeds one (1) piece of the inner sheet 101*b*. Then, the conveyer 1 feeds N−2 pieces of the center sheet 101*c* one by one. And then, the conveyer 1 feeds one (1) piece of the outer sheet 101*a*. Therefore, the inner sheet 101*b*, the center sheets 101*c* and the outer sheet 101*a* are sequentially stacked by the saddle-stitcher 3 after passing through the creaser 2.

When the detector 25 of the creaser 2 detects the passage of the front end of the inner sheet 101*b* fed first, the motor 27 of the creaser 2 does not drive so as to stop the project part 21 at the standby position (FIG. 4) because of the press of the "off" button of the third part 63.

Then, when the detector 25 of the creaser 2 detects the passage of the front end of the center sheet 101*c* fed second, the motor 27 of the creaser 2 drives because of the press of the "on" button of the second part 62. Thus, the project part 21 moves to the crease position (FIG. 5) and then returns toward the standby position (FIG. 4) by the one revolution of the crease roller 20 at the rotary speed R.

Every time the detector 25 of the creaser 2 detects the passage of the front end of each of N−2 pieces of the center sheet 101*c*, the motor 27 of the creaser 2 drives because of the press of the "on" button of the second part 62. The crease 120 is formed on the predetermined portion of each of N−2 pieces of the center sheet 101*c* by the movement of the project part 21 toward the crease position (FIG. 5).

And then, when the detector 25 of the creaser 2 detects the passage of the front end of the outer sheet 101*a* fed Nth, the motor 27 of the creaser 2 drives because of the press of the "on" button of the first part 61. The project part 21 moves to the crease position (FIG. 5) and then returns toward the standby position (FIG. 4) by the one revolution of the crease roller 20 at the rotary speed R. Thus, the crease 120 is formed on the predetermined position of the outer sheet 101*a*.

The machine according to the present invention achieves the following effects.

The operator can select the sheet 101 to be creased from among the sheets 101 fed from the conveyer 1 in view of the relation between the qualities of the sheet 101 and the toner colorant. Thus, the machine can manufacture a booklet 100 that does not have the "toner crack" and the "swell" according to various types of sheets and printers.

The booklet 100 that does not have the "toner crack" and the "swell" can be manufactured by selecting the sheets 101 to be creased from among the outer sheet 101*a*, the inner sheet 101*b* and the center sheet 101*c*. The operator can quickly and easily select whether or not to form the crease 120 on the outer sheet 101*a*, the center sheet 101*c* and the inner sheet 101*b* using the first, second and third parts 61 to 63 of the selector 60.

The project part 21 can be moved toward the crease position by the rotation of the crease roller 20. Further, the project part 21 extends to the direction S2 perpendicular to the feed direction S1. Thus, the crease roller 20 can rotate in exact timing with the passage of the sheet 101 in such a manner that the crease 120 can be formed on the predetermined portion of the sheet 101 exactly regardless the feed speed V of the sheet 101.

Hereinafter, the following another embodiments of the present invention will be described.

Figure 7A:
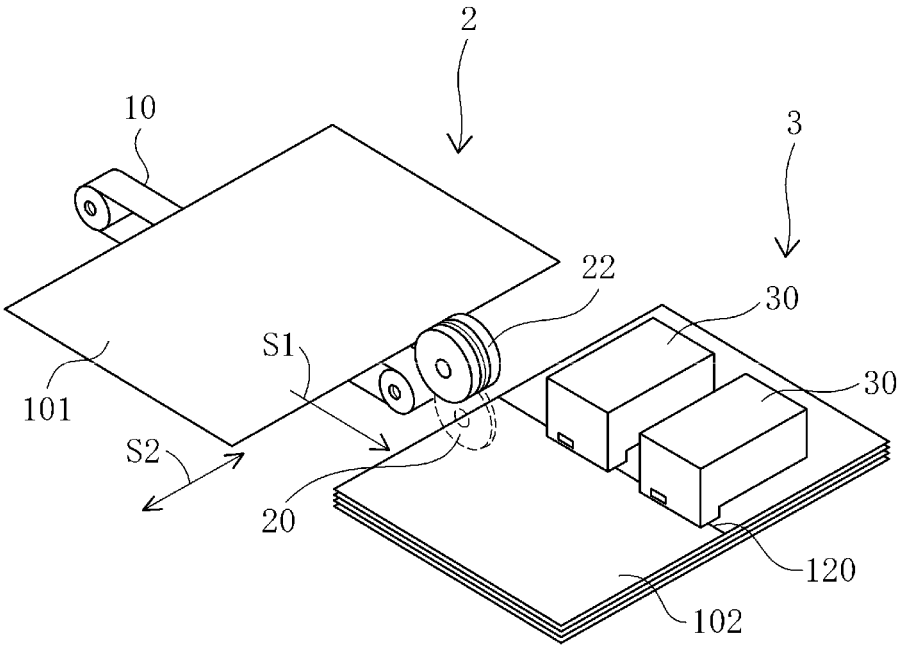
FIG. 7A is a perspective view showing another embodiment of a saddle-stitcher.
Figure 7B:
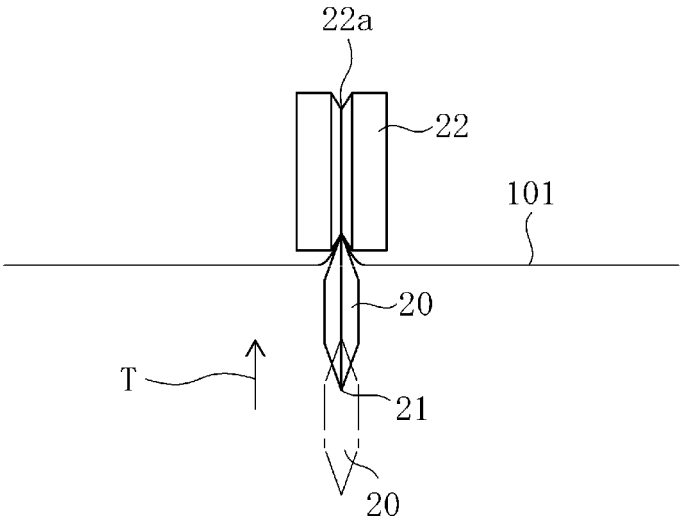
FIG. 7B is a front view showing the embodiment of FIG. 7A.

As shown in FIG. 7, in another embodiment, the crease 120 is formed on the sheet 101 in the feed direction S1. As shown in FIG. 7B, the increase and receive rollers 20 and 22 are rotated about the direction S2 perpendicular to the feed direction S1. An annular project part 21 is disposed on the crease roller 20 in its circumferential direction. Further, an annular groove 22*a* that receives the project part 21 is disposed on the receive roller 22 in its circumferential direction.

The crease roller 20 can be moved between the standby position (see a dot line in FIG. 7B) and the crease position (see a solid line in FIG. 7B) in a vertical direction T. The project part 21 is disposed at the crease position so as to form the crease on the sheet 101. The project part 21 is away from the sheet 101 at the standby position so as not to form the crease on the sheet 101.

When the sheet 101 not to be creased is fed toward the creaser 2, the crease roller 20 is s topped at the standby position in such a manner that the project part 21 is away from the sheet 101. When the sheet 101 to be creased is fed toward the creaser 2, the crease roller 20 is moved toward the crease position in such a manner that the project part 21 prods the sheet 101.

Figure 8:
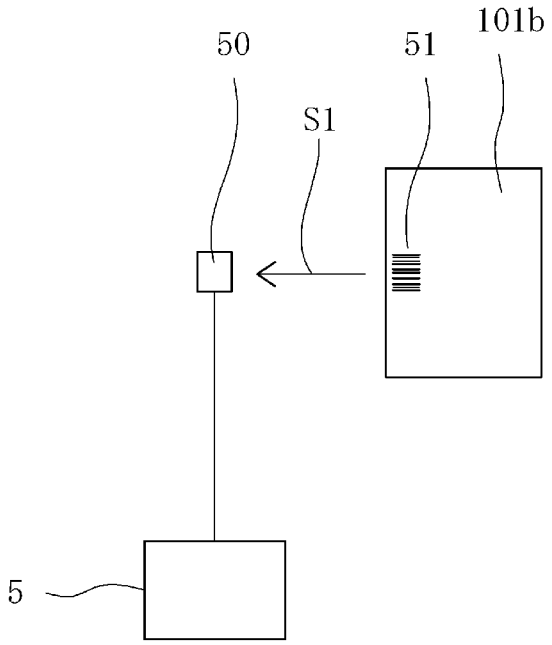
FIG. 8 is a front view showing further another embodiment of the saddle-stitcher.
Figure 9A:
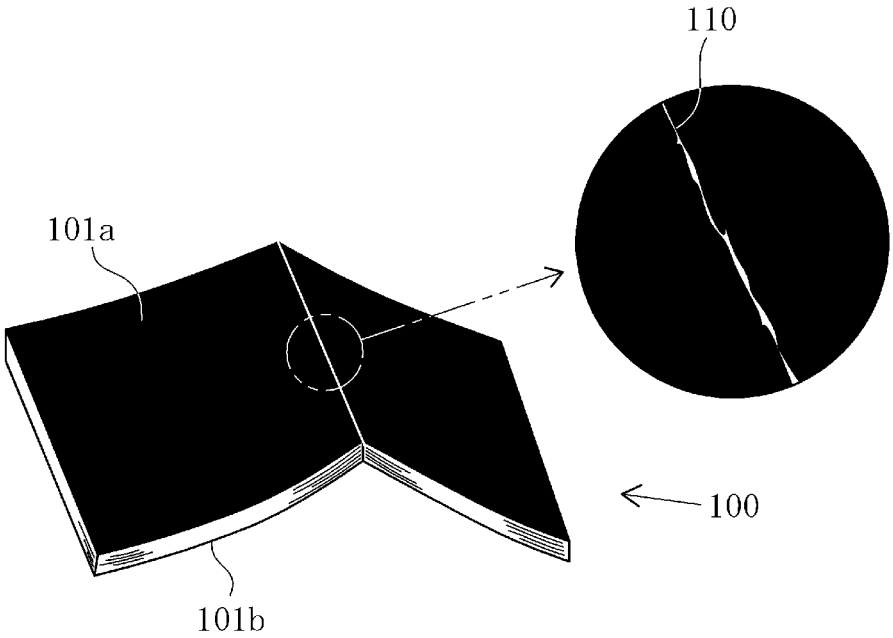
Fig. 9A (Prior Art)
FIG. 9A is an explanatory view showing a "toner crack" occurred on a booklet.
Figure 9B:
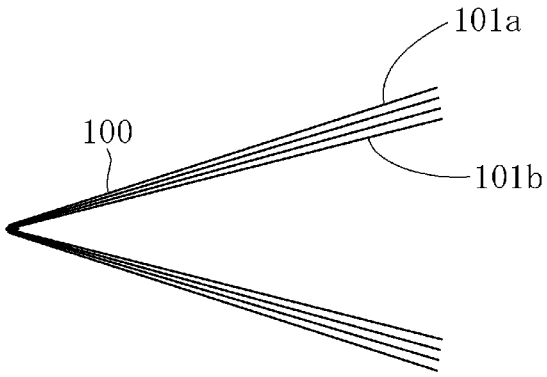
Fig. 9B (Prior Art)
FIG. 9B is an explanatory view showing a "swell" occurred on a booklet.

As shown in FIG. 8, in further another embodiment of the machine, there is a reader 50 (for example, a bar-code reader, an image sensor and so on) at the entrance of the conveyer 1 or the conveyer 2. The reader 50 reads information (for example, bar-code, image and so on) printed on the inner sheet 101*b* fed first so as to send the information on the number N of the sheets 101 composed of the booklet 100.

Although not shown, in further another embodiment, the operator can send the information on the number N of the sheets 101 composed of the booklet 100 through the input device 6.

DESCRIPTION OF THE REFERENCE CHARACTERS 1 conveyer
2 creaser
20 crease roller
21 project part
22 receive part (receive roller)
25 detector
26 rotary encoder
27 motor
3 saddle-stitcher
4 folder
5 controller
6 input device
60 selector
61 first part
62 second part
63 third part
S1 feed direction
S2 direction perpendicular to the feed direction
100 booklet
101 sheet
101*a* outer sheet
101*b* inner sheet
101*c* center sheet
102 sheet stack
120 crease

The invention claimed is:

1. A saddle-stitch and fold machine, comprising:

a conveyer that feeds a plurality of sheets one by one in a feed direction;

a detector that detects a passage of a front end of the sheet fed from the conveyer so as to send a detect signal;

a creaser that forms a crease on the sheet fed from the conveyer;

a saddle-stitcher that stacks the sheets fed from the creaser so as to make a sheet stack, and saddle-stitches the sheet stack along the crease;

a folder that folds the sheet stack fed from the saddle-stitcher along the crease;

a controller that controls the creaser, the saddle-stitcher and the folder; and an input device that receives input from an operator, wherein the creaser comprises:

a crease roller extending in another direction perpendicular to the feed direction, the crease roller provided with a roller surface having a radius and a project part extending beyond the radius in said another direction, and a receive part made of an elastic material, the receive part opposed to the crease roller with sheets fed between the crease roller and the receive part, wherein the crease roller is rotated between a crease position and a standby position, such that the project part is directed to the receive part to form the crease on the sheet when the sheet is prodded by the project part toward the receive part at the crease position, and such that the roller surface is directed to the receive part not to form the crease on the sheet at the standby position, wherein the input device includes a selector, the sheet to be creased by the creaser is selected through the selector by the operator, the input device sends select information on the sheet to be creased toward the controller, and wherein the controller controls the creaser based on both the select information from the input device and the detect signal from the detector, wherein the sheet is creased by the project part disposed at the crease position when the sheet to be creased is fed from the conveyer toward the creaser; and the sheet is not creased by the project part disposed at the standby position when the sheet not to be creased is fed from the conveyer toward the creaser.

2. The machine according to claim 1, the sheet stack to be folded by the folder corresponds to one booklet, and the sheet stack is composed of:

one outer sheet disposed on an outermost portion after the sheet stack is folded;

one inner sheet disposed on an innermost portion after the sheet stack is folded; and at least one center sheet disposed between the outer and inner sheets;

the selector includes:

a first part for selecting whether to form the crease on the outer sheet;

a second part for selecting whether to form the crease on the center sheet; and a third part for selecting whether to form the crease on the inner sheet.

3. The machine according to claim 1, the creaser further comprises:

a motor that rotates the crease roller;

a pair of feed rollers that extends in said another direction perpendicular to the feed direction so as to nip and feed the sheet; and a rotary encoder that detects a number of rotations of the feed roller so as to send a detect signal, the controller recognizes a position of the sheet based on the detect signals from both the detector and the rotary encoder so as to control the motor, whereby the project part is moved toward the crease position by rotating the crease roller so as to form the crease on a predetermined position of the sheet when the sheet to be creased is fed from the conveyer toward the creaser; and the project part is stopped at the standby position by a non-rotation of the crease roller so as not to form the crease when the sheet not to be creased is fed from the conveyer toward the creaser.

4. The machine according to claim 2, the creaser further comprises:

a motor that rotates the crease roller;

a pair of feed rollers that extends in the direction perpendicular to the feed direction so as to nip and feed the sheet; and a rotary encoder that detects a number of rotations of the feed roller so as to send a detect signal, the controller recognizes a position of the sheet based on the detect signals from both the detector and the rotary encoder so as to control the motor, whereby the project part is moved toward the crease position by a rotation of the crease roller so as to form the crease on a predetermined position of the sheet when the sheet to be creased is fed from the conveyer toward the creaser; and the project part is stopped at the standby position by a non-rotation of the crease roller so as not to form the crease when the sheet not to be creased is fed from the conveyer toward the creaser.

* * * * *